United States Patent [19]

Oplatka

[11] 4,165,783

[45] Aug. 28, 1979

[54] HEAT EXCHANGER FOR TWO VAPOR MEDIA

[75] Inventor: Georg Oplatka, Zurich, Switzerland

[73] Assignee: Brown Boveri & Company Limited, Baden, Switzerland

[21] Appl. No.: 312,384

[22] Filed: Dec. 5, 1972

[30] Foreign Application Priority Data

Dec. 17, 1971 [CH] Switzerland ..... 18428/71

[51] Int. Cl.[2] ..... F28B 1/06

[52] U.S. Cl. ..... 165/110; 122/483; 165/111; 165/146

[58] Field of Search ..... 165/111, 110, 146, 144; 122/483

[56] References Cited

U.S. PATENT DOCUMENTS

| | | | |
|---|---|---|---|
| 167,182 | 8/1875 | Mallory | 165/146 |
| 275,367 | 4/1883 | De La Vergne et al. | 165/111 |
| 686,432 | 11/1901 | Wolf | 165/111 |
| 952,102 | 3/1910 | Curtis | 165/146 |
| 1,578,830 | 3/1926 | Jones et al. | 165/146 |
| 2,200,788 | 5/1940 | Coy | 165/110 |
| 2,310,234 | 2/1943 | Haug | 165/110 |
| 3,675,710 | 7/1972 | Ristow | 165/111 |

FOREIGN PATENT DOCUMENTS

| | | | |
|---|---|---|---|
| 125968 | 1/1920 | United Kingdom | 165/111 |

*Primary Examiner*—Carroll B. Dority, Jr.
*Assistant Examiner*—Daniel J. O'Connor
*Attorney, Agent, or Firm*—Burns, Doane, Swecker & Mathi

[57] ABSTRACT

A heat exchanger for two vapor media comprises a number of straight tube bundles arranged in side-by-side horizontal relation and so connected with each other that heating steam flows through them in series. Each tube bundle is provided with a distributing chamber at the steam entrance end and a receiving chamber at the steam discharge end, a condensate drain is provided at each receiving chamber, the heating steam is throttled as it passes from the receiving chamber of one tube bundle to the distributing chamber of the next tube bundle in the series, the heat exchange areas of the tube bundles diminish in the flow direction such that the heating steam first flows through the tube bundle having the greatest heat exchange area, and steam to be superheated flows in heat exchange relation with the exterior surfaces of the tubes in a cross-counterflow manner.

4 Claims, 3 Drawing Figures

HEAT EXCHANGER FOR TWO VAPOR MEDIA

This invention concerns a heat exchanger for two vapour media, the straight, horizontal tubes of which are arranged in a number of bundles through which heating steam flows in a series arrangement while the steam to be superheated passes over the outside, each tube bundle having a distributing chamber and a receiving chamber.

In nuclear installations, in which the live steam flowing to the turbine is saturated, this steam, having expanded in the high-pressure turbine, has to be dewatered and subsequently superheated. Known methods of achieving this include combined separator/reheaters. The working steam is generally superheated by means of live steam which condenses inside tube bundles. The working steam to be superheated flows through the tube bundle outside, and transverse to, the tubes.

Reheaters of this kind are known with vertical, inclined or horizontal tube bundles. In constructions with vertical or inclined tubes, the condensate formed from the heating steam flows unhindered out of the tubes, and degassing presents no problem. This design, however, has proved difficult to achieve from the manufacturing standpoint.

In the case of heat exchangers with horizontal tubes, which are preferred on grounds of construction and cost, it is difficult to remove the condensate and non-condensing gases from the tubes. Particularly because of the different thermal loading on the tubes, accumulations of water and gas can occur as a result of which considerable portions of the heat transfer surface become ineffective.

An improvement is obtained if the tube bundle is split into two or more bundles. The condensate formed can then be removed in stages and the heat transfer surface can be better utilised. Instabilities on the heating-steam side, however, extend into the bundles following, and can also affect the preceding bundles. Also, especially with a relatively large quantity of non-condensing gases, the necessary flow rate of purging steam can be comparatively high, which leads to thermodynamic losses.

The object of the invention is to make full use of the advantages of a heat exchanger having horizontal tube bundles without incurring its disadvantages, in particular to localise any instability, reduce the flow rate of purging steam almost to the theoretically attainable minimum and to make the most economical use of the available heat transfer surfaces.

This object is achieved in that the heating steam and steam to be superheated flow relative to each other in a cross-counterflow arrangement, the heat exchange areas of the individual tube bundles diminish in the flow direction of the heating steam so that the heating steam flows first through the tube bundle having the greatest heat exchange area, the receiving chamber after each tube bundle incorporates a condensate drain, and a throttle is located in the flow path of the heating steam between at least one receiving chamber and the succeeding distributing chamber.

The invention will now be explained in more detail with reference to the accompanying schematic drawings, in which.

Figure 1:
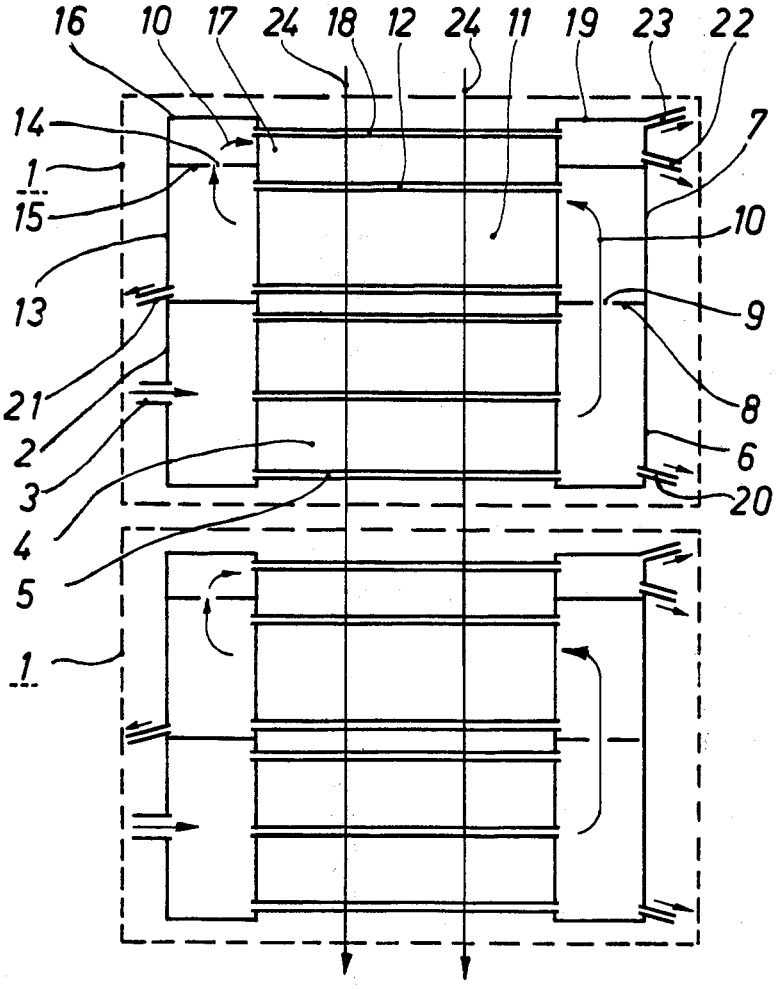
FIG. 1 shows two identical heat exchangers through which steam to be superheated flows in series.

FIG. 1 shows two identical heat exchangers 1. The heating steam is fed to distributing chamber 2 and 3 and flows through the tube bundle 4, of which only three tubes 5 are shown, to receiving chamber 6. The succeeding distributing chamber 7 is separated from receiving chamber 6 by a horizontal partition 8 which includes an orifice 9 allowing the heating steam to pass through. The heating steam, flowing in the direction indicated by arrows 10, then passes through tube bundle 11, symbolised by tubes 12, into receiving chamber 13, from there through the orifice 14 of horizontal partition 15 into distributing chamber 16 and thence through tube bundle 17, indicated by tube 18, into receiving chamber 19. The condensate precipitated from the heating steam in tube bundles 4 and 11 is drained from receiving chambers 6 and 13 at 20 and 21, and therefore does not impede heat transfer in the subsequent tube bundles. The condensate from tube bundle 17 is removed at 22. The non-condensing gases, chiefly air, are extracted at a draw-off outlet 23 from the last receiving chamber 19 together with the remainder of the heating steam not yet condensed.

On its way through the tubes of bundles 4, 11 and 17 the heating steam flows (in the drawing) in an upward direction. The steam to be superheated flows downwards over the tubes of the bundles, as indicated by the arrows 24. Because of this cross-counterflow arrangement within the heat exchanger, the steam to be superheated meets first, i.e. when it is coolest, the residual part of the heating steam which contains the most non-condensing gases and has the lowest pressure, and hence the lowest temperature. If slug flow should occur, it is restricted to one tube bundle 17, which constitutes a small proportion of the total area. Thus in this case also, the counterflow arrangement yields the best average heat transmission coefficient for the whole heat exchanger, and hence savings in heat transfer area.

The purpose of the orifices in the partitions between the receiving and distributing chambers is to create stepwise pressure changes in the flow path of the heating steam. In this way it is possible to eliminate the risk of flow reversals and also to separate the individual tube bundles or groups of tube bundles so that any instability is restricted to one tube bundle or groups of bundles and cannot propagate in the flow direction. Also, the steam is superheated to a certain extent by being throttled in the orifices, the result of this, together with the condensate drains from the receiving chambers, being that the steam contains no water on flowing into the tube bundles.

If the steam has to be superheated through a relatively large temperature range, to reduce thermodynamic losses it is of benefit to employ two heat exchangers supplied with heating steam of different temperatures. An arrangement of this kind is also illustrated in FIG. 1. Again, the two heat exchangers 1 are in a counterflow configuration, and in such a way that the heat exchanger first exposed to the steam to be superheated is heated by heating steam of the lower temperature, and the second heat exchanger is heated by heating steam of the higher temperature.

In another design the receiving chamber and the following distributing chamber are connected by a pipe.

Figure 2:
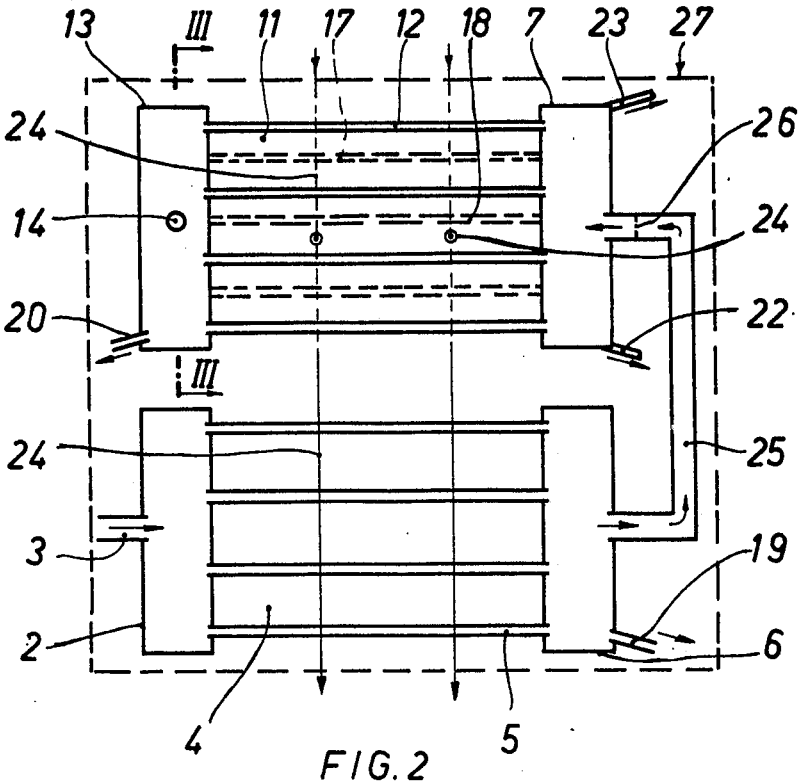
FIG. 2 is a heat exchanger of another construction.

This construction is illustrated by the heat exchanger 27 of FIG. 2. Here again there are three tube bundles 4, 11 and 17 through which heating steam flows successively. The receiving chamber 6 after the first tube bundle 4 is connected to the distributing chamber 7 of the next tube bundle 11 only by way of pipe 25. This pipe can also be made to act as a throttle. A further possibility is to make the connecting pipe 25 larger, but to fit orifice 26 inside it. The desired pressure step in the flow path of the heating steam is achieved in both cases. It is evident that a similar connecting pipe can also be located between tube bundles 11 and 17. Also, two of these assemblies 27 can be combined into one unit through which the steam to be superheated flows in series.

Figure 3:
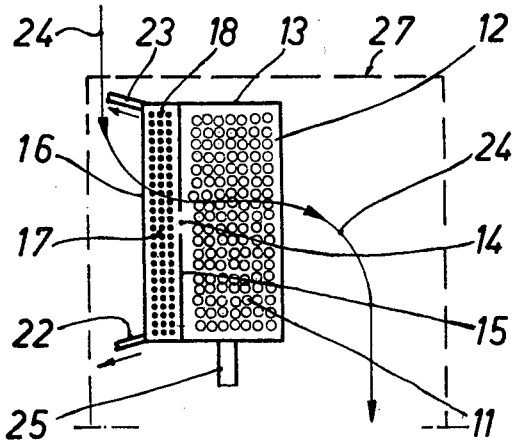
FIG. 3 is a section through a receiving chamber of FIG. 2 at III—III and viewed in the direction of the arrows.

The tube bundle through which the steam to be superheated flows first can also be of the configuration shown in FIG. 3, where the tube bundles 11 and 17 are built together. The distributing chamber 7 (FIG. 2) contains a vertical partition (not shown) so that the incoming heating steam flow through pipe 25 reaches only tubes 12, but not tubes 18. Receiving chamber 13 contains a vertical partition 15 with orifice 14, thus forming a new distributing chamber 16 from where steam is supplied to tubes 18. These terminate in a receiving chamber (not visible in the drawing) which is separated from the distributing chamber 7 by the partition and from which condensate is drained at 22 and non-condensing gases at 23. In order to retain a counterflow arrangement in this version, the steam to be superheated is passed through the bundles 17 and 11 in the manner indicated by the arrow 24 in FIG. 3. This configuration is applicable not only to a heat exchanger as shown in FIG. 2, but can be applied equally to a heat exchanger as shown in FIG. 1.

It is to be understood that in all versions the heat exchangers can also be so arranged that the steam to be heated flows through them horizontally or in an upward direction.

I claim:

1. A heat exchanger for superheating of saturated steam by means of heating steam which condenses comprising a number of tube bundles connected in series and through which heating steam flows, each tube bundle being composed of straight horizontal tubes and including a distributing chamber and a receiving chamber, the steam to be superheated passing over the outside of the tubes, the heating steam and the steam to be superheated flowing relative to each other in a cross-counterflow manner, the heat exchange areas of the individual tube bundles diminishing in the flow direction of the heating steam such that the heating steam flows first through the tube bundle having the greatest heat exchange area, the receiving chamber after each tube bundle incorporating a condensate drain, a throttle located in the flow path of the heating steam between at least one receiving chamber and the succeeding distributing chamber and a draw-off outlet from the last receiving chamber through which non-condensing gases together with the remainder of the heating steam not yet condensed are extracted.

2. A heat exchanger as defined in claim 1 wherein said throttle comprises an orifice provided in a partition located between the receiving chamber of one tube bundle and the distributing chamber of the next tube bundle in the series.

3. A heat exchanger as defined in claim 1 wherein the receiving chamber and the distributing chamber of successive tube bundles are connected by a pipe configured to form a throttle.

4. A heat exchanger as defined in claim 3 wherein said connecting pipe contains an orifice.

* * * * *